US011369132B2

(12) United States Patent
Terao

(10) Patent No.: US 11,369,132 B2
(45) Date of Patent: Jun. 28, 2022

(54) HEAT REVERSIBLE COMPOSITION FOR SMOKING GOODS THAT ARE GEL-LIKE AT NORMAL TEMPERATURES

(71) Applicant: JAPAN TOBACCO INC., Tokyo (JP)

(72) Inventor: Fumitaka Terao, Tokyo (JP)

(73) Assignee: JAPAN TOBACCO INC., Tokyo (JP)

( * ) Notice: Subject to any disclaimer, the term of this patent is extended or adjusted under 35 U.S.C. 154(b) by 268 days.

(21) Appl. No.: 15/679,822

(22) Filed: Aug. 17, 2017

(65) Prior Publication Data

US 2017/0340005 A1 Nov. 30, 2017

Related U.S. Application Data

(63) Continuation of application No. PCT/JP2016/054544, filed on Feb. 17, 2016.

(51) Int. Cl.

| | |
|---|---|
| ***A24B 15/167*** | (2020.01) |
| ***A24B 15/32*** | (2006.01) |
| ***A24B 15/10*** | (2006.01) |
| ***A24B 15/40*** | (2006.01) |
| ***A24F 47/00*** | (2020.01) |

(52) U.S. Cl.

CPC ..... *A24B 15/32* (2013.01); *A24B 15/10* (2013.01); *A24B 15/167* (2016.11); *A24B 15/40* (2013.01); *A24F 47/00* (2013.01)

(58) Field of Classification Search

CPC ..... A24B 15/32; A24B 15/167; A24B 15/10; A24B 15/40; A24F 47/00

USPC ..... 131/276

See application file for complete search history.

(56) References Cited

U.S. PATENT DOCUMENTS

| | | | | |
|---|---|---|---|---|
| 5,240,016 | A | 8/1993 | Nichols et al. | |
| 5,415,186 | A | 5/1995 | Casey, III et al. | |
| 5,746,225 | A | 5/1998 | Okumoto et al. | |
| 6,019,106 | A | 2/2000 | Okusawa et al. | |
| 6,247,475 | B1 | 6/2001 | Sato | |
| 2012/0294893 | A1* | 11/2012 | Asari | A61K 47/36 424/275.1 |
| 2013/0255702 | A1 | 10/2013 | Griffith, Jr. et al. | |
| 2013/0319430 | A1* | 12/2013 | Tanaka | A24B 15/302 131/275 |
| 2013/0327346 | A1 | 12/2013 | Tanaka et al. | |

FOREIGN PATENT DOCUMENTS

| | | | |
|---|---|---|---|
| CN | 103561596 | A | 2/2014 |
| CN | 103960784 | A | 8/2014 |
| EP | 0 457 587 | A2 | 11/1991 |

(Continued)

OTHER PUBLICATIONS http://www.bisi.cz/cmsres.axd/get/cms$7CVwRhc3USVqgzxkKF96gl$2BChNrXcTq$2BOUdiEtz5TfYA8ddjj4p8U38mxMAaJb9pNa (Year: 2008).*

(Continued)

*Primary Examiner* — Michael J Felton

(74) *Attorney, Agent, or Firm* — Birch, Stewart, Kolasch & Birch, LLP

(57) ABSTRACT

The present invention provides a thermoreversible composition for smoking goods that are gel-like at normal temperatures, comprising glycerin at 69.0-94.8 wt % with respect to the entirety of the composition, native-type gellan gum at 0.2-1.0 wt % with respect to the entirety of the composition, and water at 5.0-30.0 wt %.

8 Claims, 6 Drawing Sheets

(56) References Cited

FOREIGN PATENT DOCUMENTS

| | | | |
|---|---|---|---|
| JP | 4-228042 | A | 8/1992 |
| JP | 5-153946 | A | 6/1993 |
| JP | 9-248170 | A | 9/1997 |
| JP | 10-99067 | A | 4/1998 |
| JP | 11-169152 | A | 6/1999 |
| JP | 11-196843 | A | 7/1999 |
| JP | 2014-524313 | A | 9/2014 |
| WO | WO 2013/025921 | A1 | 2/2013 |

OTHER PUBLICATIONS

First Office Action dated Feb. 23, 2018, in Chinese Patent Application No. 201680009238.8, with English translation.

English translation of International Preliminary Report on Patentability and Written Opinion dated Aug. 31, 2017, in PCT International Application No. PCT/JP2016/054544.

Encyclopedia of Tobacco, edited by Tobacco Academic Studies Center, Mar. 31, 2009, p. 362.

International Search Report (PCT/ISA/210) issued in PCT/JP2016/054544, dated May 24, 2016.

Written Opinion of the International Searching Authority (PCT/ISA/237) issued in PCT/JP2016/054544, dated May 24, 2016.

CPKELCO, "KELCOGEL gellan gum," Gellan Gum Book, 5th Edition, 2007, pp. 1-28 (30 pages total).

European Notice of Opposition for European Application No. 16752495.8, dated Mar. 31, 2020.

Saha et al., "Hydrocolloids as thickening and gelling agents in food: a critical review," J. Food. Sci. Technol., vol. 47, No. 6, Nov.-Dec. 2010 (published online Nov. 6, 2010), pp. 587-597.

San-Ei Gen F.F.I Inc., "Gellan Gum," Product Brochure, 2008, pp. 1-19 (37 pages total), with English translation.

* cited by examiner

HEAT REVERSIBLE COMPOSITION FOR SMOKING GOODS THAT ARE GEL-LIKE AT NORMAL TEMPERATURES

The present application is a continuation application of International Application No. PCT/JP2016/054544, filed Feb. 17, 2016, which claims priority to Japanese Patent Application No. 2015-029236, filed Feb. 18, 2015. The contents of these applications are incorporated herein by reference in their entirety.

BACKGROUND OF THE INVENTION

The present invention relates to a thermoreversible composition for a smoking article exhibiting a gel-form at normal temperature.

As means for enjoying the flavors and tastes of tobaccos, cigarettes and electric heating tobaccos have been known. Generally, a cigarette is smoked in such a manner as to wrap shredded tobacco, which is obtained by shredding a tobacco leaf into a suitable size and appropriately processing the same, on a tobacco wrapping paper and then ignite the end of the tobacco wrapping paper. Further, in a certain type of electric heating tobacco, a composition (composition serving as a generation source for aerosol) in which shredded tobacco and a vapor forming medium are mixed together is arranged inside an electric heating tobacco tool in a state of being put in a container (pod). The composition serves as the generation source for the aerosol containing a flavor and taste component contained in the shredded tobacco. When the pod containing the composition serving as the generation source for the aerosol arranged inside the electric heating tobacco tool is heated by electric heating, the aerosol containing the flavor and taste component of the tobacco is generated and inhaled by a user.

Japanese Translation of PCT Application No. 2014-524313 (Patent document 1) describes an adhesive vaporizable material as a vapor forming medium contained in a composition serving as a generation source for aerosol arranged inside an electric heating tobacco tool, and specifically describes propylene glycol, glycerin, or their combination as such.

On the other hand, a phenomenon called a "loose end" in which shredded tobacco drops off from the tip of a cigarette occurs in the cigarette, which causes a problem in quality management (Encyclopedia of Tobacco, p. 362, edited by Tobacco Academic Studies Center on Mar. 31, 2009; Non-Patent Document 1).

In order to address the problem, in many cases, a cigarette in which a loose end has occurred or is highly likely to occur is detected and removed at an inspection stage during a manufacturing process to attain the stability of article quality. For example, in order to secure quality, Japanese Patent Application Laid-open No. H9-248170 (Patent document 2) discloses a technology for a tobacco winding-up machine to remove a tobacco causing a loose end due to insufficient amount of shredded tobacco at the end portion thereof.

Further, as a technology for improving the structure of the constituents of a cigarette, Japanese Patent Application Laid-open No. H10-99067 (Patent document 3) discloses a cigarette in which a multiplicity of convex parts is provided by means such as embossing or the like on the inner surface of a wrapping paper contacting shredded tobacco to increase the frictional coefficient between the shredded tobacco and the wrapping paper to prevent a loose end.

Further, Japanese Patent Application Laid-open No. H11-169152 (Patent Document 4) and Japanese Patent Application Laid-open No. H11-196843 (Patent document 5) disclose a technology for performing the compression molding of shredded tobacco to reduce a fluctuation in the shredded tobacco to prevent a loose end.

SUMMARY OF THE INVENTION

In electric heating cigarettes, a granular component such as shredded tobacco that may be contained in a composition serving as a generation source for aerosol is likely to be scattered from a container (pod) when the container containing the composition is transported. In addition, a phenomenon called a loose end occurs in the cigarettes as described above.

In order to prevent these phenomena, there has been demanded to reduce the flowability of compositions applied to smoking articles such as electric heating cigarettes and cigarettes. In addition, in order to efficiently generate aerosol with electric heating, there has been demanded to increase the heat sensitivity of compositions serving as generation sources for the aerosol to a greater extent when the compositions are applied to electric heating cigarettes.

Moreover, it has been demanded that compositions serving as generation sources for aerosol be compositions that have high viscosity and hardly flow at normal temperature but increase flowability with an increase in temperature, i.e., thermoreversible compositions from the viewpoint of their preparation convenience.

Since the vapor forming medium described in Japanese Translation of PCT Application No. 2014-524313 has a high specific heat and relatively high flowability even at normal temperature, there is a likelihood that the above problems cannot be solved. Further, as for the loose end of cigarettes, there has not been known a technology for adding any substance to shredded tobacco to solve the problem of the loose end unlike the inventions of Patent Document 2 to 5.

In view of the above circumstances, the present invention addresses the problem of providing a gel-form thermoreversible composition for a smoking article that has high viscosity and low flowability at normal temperature but is fluidized with an increase in its temperature, easily aerosolized with heat, and presents a good smoking flavor.

After the dedicated study of the present inventors, it has been found that a thermoreversible composition, which contains 0.20 to 1.00 wt % of native gellan gum, 5.0 to 30.0 wt % of water, and 69.0 to 94.8 wt % of glycerin and exhibits a gel-form at normal temperature, can solve the above problem.

Generally, it has been known that many kinds of polysaccharides are gelled with the addition of water. However, when glycerin larger in amount than water exists in systems, it has been difficult to obtain gelled compositions with a smaller amount of the water. However, as described above, thermoreversible compositions exhibiting a gel-form at normal temperature and containing a specifically small amount of water have been obtained by the control of the contents of glycerin, native gellan gum, and the water. In addition, it has been found that the compositions are applicable to cigarettes or electric heating cigarette tools.

That is, the present invention is configured as follows.

[1] A thermoreversible composition for a smoking article exhibiting a gel-form at normal temperature, the thermoreversible composition including, relative to a total amount of the composition: 69.0 to 94.8 wt % of glycerin; 0.2 to 1.0 wt % of native gellan gum; and 5.0 to 30.0 wt % of water.

[2] The thermoreversible composition for a smoking article exhibiting a gel-form at normal temperature according to the above item [1], wherein the thermoreversible composition is obtained by high-speed agitation mixing.

[3] The thermoreversible composition for a smoking article exhibiting a gel-form at normal temperature according to the above item [1] or [2], wherein a content of the water in the thermoreversible composition is 13.0 to 25.0 wt %.

[4] The thermoreversible composition for a smoking article exhibiting a gel-form at normal temperature according to any one of the above items [1] to [3], wherein a content of the native gellan gum in the thermoreversible composition is 0.5 to 1.0 wt %.

[5] The thermoreversible composition for a smoking article exhibiting a gel-form at normal temperature according to any one of the above items [1] to [4], wherein a content of the glycerin in the thermoreversible composition is 74.0 to 86.5 wt %.

[6] The thermoreversible composition for a smoking article exhibiting a gel-form at normal temperature according to any one of the above items [1] to [5], wherein a ratio of the native gellan gum to the water in the thermoreversible composition is 1:25 to 13:50.

[7] An electric heating tobacco tool including: the thermoreversible composition for a smoking article exhibiting a gel-form at normal temperature according to any one of the above items [1] to [6].

[8] A cigarette including: the thermoreversible composition for a smoking article exhibiting a gel-form at normal temperature according to any one of the above items [1] to [6].

The thermoreversible composition of the present invention exhibits a gel-form and has low flowability at normal temperature. Therefore, after being applied to the shredded tobacco of a cigarette or accommodated in a pod inside an electric heating tobacco tool, the composition is allowed to more firmly retain the shredded tobacco compared with a case in which a liquid is added. As a result, the composition is prevented from being fluidized to cause the drop of the shredded tobacco (loose end), or the shredded tobacco inside the pod is prevented from being scattered. In addition, the composition can be affected by heat and has a sol form when being heated. Therefore, it is easy to control the properties of the composition when the composition is added to the shredded tobacco. Moreover, when being heated, the composition of the present invention has higher heat sensitivity than that of a gel composition containing a large amount of water. Therefore, aerosol can be efficiently generated even with a small amount of heat.

Further features of the present invention will become apparent from the following description of exemplary embodiments (with reference to the attached drawings).

DESCRIPTION OF THE EMBODIMENTS

Figure 1:
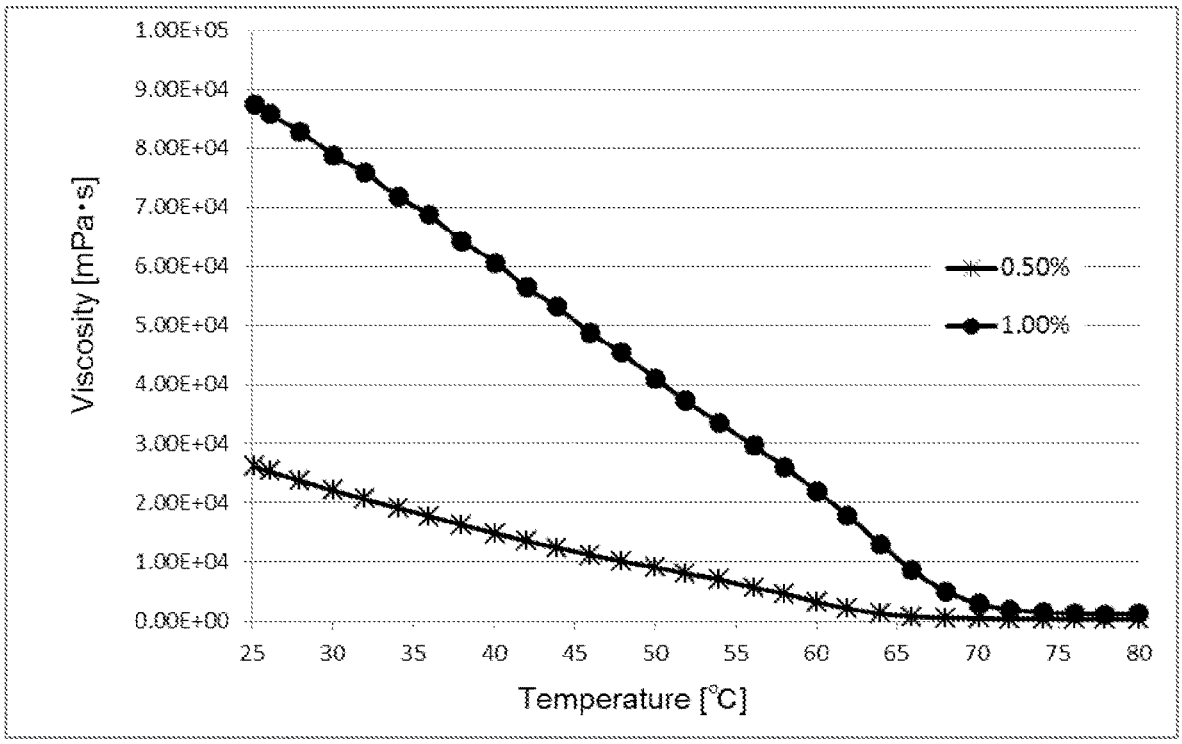
FIG. 1 is a diagram showing the relationship between the viscosity and the temperature of thermoreversible compositions in which the contents of a gelling agent (native gellan gum) are 0.50 wt % and 1.00 wt % among the thermoreversible compositions of Example 2.

Hereinafter, a description will be given in detail of the present invention based on an embodiment, illustrative objects, or the like, but the present invention is not limited to the following embodiment, the illustrative objects, or the like and can be arbitrarily modified and carried out without departing from its spirit.

A thermoreversible composition for a smoking article of the present invention contains glycerin, native gellan gum, and water.

Glycerin containing no water can be used, but glycerin containing water of up to 30 wt % may be used.

When the thermoreversible composition of the present invention contains water besides water contained in glycerin, the content of the water in the thermoreversible composition is the sum of the water.

In order to secure the gel-form of the thermoreversible composition of the present invention at normal temperature, the content of glycerin in the thermoreversible composition of the present invention is 69.0 to 94.8 wt % and preferably 74.0 to 86.5 wt %.

The thermoreversible composition of the present invention contains native gellan gum. Native gellan gum and deacylated gellan gum have been known as commercial items, but the present invention uses native gellan gum. Native gellan gum makes a composition have a gel-form at normal temperature and provides thermoreversibility. In addition, native gellan gum provides a good smoking flavor when a thermoreversible composition is used in an electric heating tobacco tool.

As is clear from the results of the following Examples, native gellan gum is only one that can give such properties to a composition.

Native gellan gum is one in which an acetyl group and a glyceryl group exist in 1-3 bond glycose. Native gellan gum used in the present invention can have an average molecular weight of 100,000 to 700,000.

The content of the native gellan gum in the thermoreversible composition of the present invention can be 0.2 to 1.0 wt % and preferably 0.50 to 1.00 wt %.

The upper limit and the lower limit of the content of the native gellan gum in the thermoreversible composition of the present invention are set to make the thermoreversible composition of the present invention have a gel-form having suitable viscosity at normal temperature.

The thermoreversible composition of the present invention contains water. The content of the water in the thermoreversible composition of the present invention can be 5.0 to 30.0 wt % and preferably 13.0 to 25.0 wt %. The lower limit of the content of the water is set to make the thermoreversible composition of the present invention have a gel-form at normal temperature, while the upper limit thereof is set from the viewpoint of setting the heat sensitivity of the thermoreversible composition of the present invention in a desired range.

The weight ratio of the native gellan gum to the water in the composition is preferably 1:25 to 13:50 from the viewpoint of making the thermoreversible composition have desired viscosity.

Note that "thermoreversibility" mentioned in the present invention indicates a property in which the composition causes a sol-gel transition depending on temperature. Specifically, the composition has a sol form at 70° C. or more and has a gel-form at 60° C. or less.

In addition, the "gel-form" mentioned in the present invention indicates a state in which the composition loses its flowability unlike the sol form. Specifically, the gel-form indicates a state in which, even when the composition is accommodated in a container such as a vial container and then the container is toppled down, the composition is not scattered to the whole inner side surface of the container positioned on a lower side after the toppling, and the state can be visually observed.

The viscosity of the thermoreversible composition of the present invention at 25° C. (normal temperature) is measured by the following examination.

<Examination Conditions>

Using a revolving viscometer HAKKE RheoStress 1 (Thermo Fisher Scientific Inc.), complex viscosity obtained at the measurement of viscoelasticity in a linear deformation region is measured. Measurement conditions are as follows.

[Measurement Conditions]

Constant stress: 5 Pa

Constant speed: 1 Hz

Sample injection amount: 3 mL

Measurement temperature range: 80° C. to 25° C.

As a measurement method, 3 mL of a sample is injected into a tray after being heated to 80° C., and a contact is lowered to enclose the sample with silicone oil. When the temperature of the tray reaches 80° C., measurement is started to measure viscosity at each temperature up to 25° C.

The viscosity of the thermoreversible composition of the present invention at 25° C. is preferably 2000 mPa·s or more and preferably 90,000 mPa·s or less.

When the viscosity of the thermoreversible composition at 25° C. is 2000 mPa·s or more, the ability to substantially retain shredded tobacco or the like when the thermoreversible composition is applied to a smoking article can be provided. When the thermoreversible composition is applied to a cigarette, a loose end can be prevented. When the thermoreversible composition is applied to an electric heating tobacco tool, the omission of shredded tobacco can be prevented.

On the other hand, when the viscosity of the thermoreversible composition at 25° C. is 90,000 mPa·s or less, the thermoreversible composition of the present invention can be prevented from having a solid gel-form more than necessary and the breakage of a manufacturing apparatus can be prevented.

The heat sensitivity of the thermoreversible composition of the present invention is determined by the temperature increasing speed of the composition when the composition is heated at 165° C. as will be described later. By the gelling of the composition, the temperature of the thermoreversible composition efficiently increases even with a slight amount of heat when a container accommodating the thermoreversible composition of the present invention arranged inside an electric heating tobacco tool is heated by an electronic heater. Thus, the glycerin of the thermoreversible composition inside the container is efficiently aerosolized. The aerosolized glycerin simultaneously contains a component derived from any component contained in the thermoreversible composition, for example, a flavor and taste component contained in shredded tobacco when the composition contains the shredded tobacco that will be described later. In the use of an electric heating tobacco tool, generated aerosol is inhaled by a user. However, when the content of the water in the thermoreversible composition is large, the heat sensitivity of the composition itself also reduces due to the low responsiveness of the contained water to heat.

"Heat sensitivity" mentioned in the present specification is a property regarding a degree to which the temperature of a composition itself changes with a change in temperature. High heat sensitivity indicates a state in which the temperature of the composition itself quickly changes with a change in surrounding temperature.

The "heat sensitivity" of the thermoreversible composition of the present invention can be measured by the following method.

In an aluminum pod (having a volume of 0.47 $cm^3$) accommodated in an electric heating tobacco tool, a composition containing shredded tobacco prepared by mixing targeted 10 parts by weight of a gel thermoreversible composition, 59 parts by weight of the shredded tobacco, and 31 parts by weight of propylene glycol together is put. Then, pressure is applied using a jig having a conical tip to the composition containing the prepared shredded tobacco to be pushed into the pod.

When the temperature of the portion of the electric heating tobacco tool where the pod is heated reaches 165° C. (when an overheat lamp switches to a lighting state) after the electric heating tobacco tool (PLOOM) is turned on, the prepared pod is accommodated in the electric heating tobacco tool to arrange a thermocouple at the innermost portion of the pod into which the composition containing the shredded tobacco is pressed. By the measurement of a time (second) until the temperature of the composition containing the prepared shredded tobacco reaches 160° C., a time (second) until the temperature (temperature of the article) of the composition reaches 160° C. is measured.

It can be said that the shorter the number of seconds, the higher the heat sensitivity of the composition is.

The thermoreversible composition of the present invention is preferably such that the time until the temperature of the composition reaches 160° C. is less than or equal to 180 seconds since a time required for aerosolizing the composition is shortened. In addition, the thermoreversible composition of the present invention is more preferably such that the time until the temperature of the composition reaches 160° C. is less than or equal to 160 seconds or less.

The heat sensitivity can be controlled by the control of the content of the water in the thermoreversible composition of the present invention.

The viscosity of the thermoreversible composition of the present invention can be controlled by, for example, the control of the contents of the water and the native gellan gum.

Specifically, in order to control the viscosity of the thermoreversible composition, increasing the amount of the native gellan gum or increasing the content of the water relative to a certain amount of more of the native gellan gum is performed.

The thermoreversible composition of the present invention is preferably obtained by the high-speed agitation mixing of the above materials.

The high-speed agitation mixing indicates mixing the materials together with a mixer including a rotor and a stator such as a high-speed agitation mixer, the mixer performing a high dispersion function when the rotor revolves with delicate clearance provided between the rotor allowing high-speed revolution and the fixed stator.

In order to produce such a high dispersion function, the number of the revolutions of the rotor can be set at 3000 to 5000 rpm although the high dispersion function depends on the size of the device. The number of the revolutions of the rotor can be preferably 3500 to 4500 rpm and more preferably 3800 to 4200 rpm. As such a high-speed agitation mixer, a commercially-available article, for example, a homomixer can be used.

The high-speed agitation mixing of the materials can be performed at 50 to 70° C. for 10 to 60 minutes, and preferably performed at 55 to 65° C. for about 10 to 20 minutes.

As a device for performing shear mixing, a homomixer can be used. For example, a homomixer manufactured by PRIMIX Corporation (ultra high-speed multi agitation system LABOLUTION) can be used.

When the high-speed agitation mixing as described above is performed to prepare the thermoreversible composition in the present invention, the native gellan gum is favorably dissolved in the water contained in the composition, which allows the composition to have desired viscosity and improves the heat sensitivity of the composition. Such favorable dissolving does not occur only with the simple dispersion of the glycerin, the native gellan gum, and the water, and the desired heat sensitivity and viscosity of the composition are hardly obtained.

As the order of a high-speed agitation process, the glycerin, the native gellan gum, and the water may be mixed together in advance before the above high-speed agitation mixing, or the glycerin containing the water in advance and the native gellan gum may be subjected to the above high-speed agitation mixing.

The thermoreversible composition of the present invention can be applied to an electric heating tobacco tool.

The electric heating tobacco tool has been put on the market as PLOOM (brand name) and includes a mouthpiece, a body having a pod in which the thermoreversible composition is accommodated and an electronic heater, a temperature controller that controls the temperature of the electronic heater, or the like. Specifically, a configuration described in Japanese Translation of PCT Application No. 2014-524313 can be used.

The thermoreversible composition of the present invention is accommodated in the above pod. The material of the pod in which the thermoreversible composition of the present invention is accommodated is not particularly limited, and the pod can be made of metal having high heat conductivity such as aluminum.

When being applied to the above electric heating tobacco tool, the thermoreversible composition of the present invention is accommodated in the above pod together with shredded tobacco.

A tobacco type used as the shredded tobacco is not particularly limited, and the yellow species and burley species of *Nicotiana tabacum*, the Brasilia species of *Nicotiana rustica*, or the like belonging to *Nicotiana* can be, for example, used.

The size of the shredded tobacco is not particularly limited, and the size of shredded tobacco used in a normal electric heating tobacco tool can be employed.

The weight ratio of the thermoreversible composition to the shredded tobacco of the present invention can be such that the thermoreversible composition is contained at a ratio of about 3:2 to 9:1 relative to the dry weight of the shredded tobacco.

The thermoreversible composition of the present invention may contain other components. For example, the thermoreversible composition may contain thickening polysaccharides other than the native gellan gum.

Due to its heat sensitivity and viscosity characteristics, the thermoreversible composition of the present invention is particularly suitable as a composition serving as a generation source for aerosol and arranged inside an electric heating tobacco tool. More specifically, the thermoreversible composition of the present invention is suitable as a composition for generating aerosol containing a flavor and taste component contained in shredded tobacco when the thermoreversible composition contains the shredded tobacco.

In addition, the thermoreversible composition of the present invention may be applied to the shredded tobacco of a tobacco rod constituting a cigarette. A cigarette to which the thermoreversible composition of the present invention may be applied can be a known cigarette, and the thermoreversible composition may be applied to both a cigarette with a filter or a cigarette without a filter. At this time, the type of the applied shredded tobacco is not particularly limited, and a known type of shredded tobacco can be used. For example, the same shredded tobacco as that used in the electric heating tobacco tool described above can be used.

When the thermoreversible composition of the present invention is applied to shredded tobacco, its additive amount can be 20 to 60 mg per cigarette.

Moreover, the area of a tobacco rod constituted by shredded tobacco to which the thermoreversible composition of the present invention is applied is not particularly limited, and the thermoreversible composition can be added to the tip end of the tobacco rod on its burning side or can be added to the whole tobacco rod.

Thus, a loose end can be prevented.

A cigarette can be manufactured using a known cigarette manufacturing method except for the application of the thermoreversible composition of the present invention.

EXAMPLES

A description will be given in further detail of the present invention based on Examples. The present invention is not limited to the following Examples unless deviating from the gist of the invention.

Example 1

94.5 parts by weight of glycerin containing 18 parts by weight of water and 0.5 parts by weight of native gellan gum were put in a homomixer manufactured by PRIMIX Corporation (ultra high-speed multi agitation system LABOLUTION), and the materials were subjected to high-speed agitation mixing at 80° C. and 4000 rpm for 15 minutes:

Comparative Examples 1 to 10

Except for changing polysaccharides, the compositions of Comparative Examples 1 to 10 were obtained by the same procedure as that of Example 1. Properties and smoking flavors are shown in Table 1.

First, the states of the compositions obtained in Example and Comparative Examples were visually observed. In the column of the "presence or absence of gelling" in Table 1, gelled compositions and ungelled compositions under visual observation are summarized as being "○" (good) and "X" (poor), respectively.

As a result, gel compositions were obtained only in Example 1 and Comparative Example 6 in which native gellan gum or carrageenan among a plurality of types of saccharides was used, respectively.

In addition, for the gelled compositions of Example 1 and Comparative Example 6, the temperatures of the compositions were changed to confirm the occurrence of a sol-gel transition in the compositions. Since both the gel compositions of Example 1 (containing the native gellan gum) and Comparative Example 6 (containing the carrageenan) exhibited a sol form at 80° C. and a sol-gel transition at 65° C. or so, the compositions had thermoreversibility.

TABLE 1

| | Example 1 | Comp. Example 1 | Comp. Example 2 | Comp. Example 3 | Comp. Example 4 | Comp. Example 5 | Comp. Example 6 | Comp. Example 7 | Comp. Example 8 | Comp. Example 9 | Comp. Example 10 |
|---|---|---|---|---|---|---|---|---|---|---|---|
| Polysaccharide | Native gellan gum | Xanthan gum | Guar gum | Gelatin | Deacylated gellan gum | Tamarind gum | Carrageenan | Locust bean gum | Pectin | Agar | Gum arabic |
| Presence or absence of gelling | ○ | X | X | X | X | X | ○ | X | X | X | X |
| Thermo-reversibility | ○ | — | — | — | — | — | ○ | — | — | X | — |
| Smoking flavor | ○ | — | — | — | — | — | X | — | — | — | — |

For the compositions of Example 1 and Comparative Example 6, smoking flavor evaluation was conducted. As a result, a good smoking flavor was obtained only in Example 1. It appears that a sulfide compound contained in the composition of the carrageenan used in Comparative Example 6 has an adverse effect on a smoking flavor.

The smoking flavors were measured by the following method.

10 wt % of the gel compositions obtained by subjecting the polysaccharides of Example 1 and Comparative Example 6, the water, and the glycerin to the high-speed agitation mixing as described above was filled in a pod together with 59 wt % of shredded tobacco and 31 wt % of propylene glycol to obtain a PLOOM cartridge. Then, the tobacco smoking flavors were evaluated by six male professionals and one female professional based on the following criteria.

<Irritating Odor>

1. Irritating
2. Slightly irritating
3. Neutral
4. Slightly non-irritating
5. Not irritating Results are shown in Table 2.

TABLE 2

| Professional person | Native gellan gum (Example 1) | Carrageenan (Comparative Example 6) |
|---|---|---|
| A | 5 | 1 |
| B | 5 | 2 |
| C | 5 | 1 |
| D | 4 | 1 |

TABLE 2-continued

| Professional person | Native gellan gum (Example 1) | Carrageenan (Comparative Example 6) |
|---|---|---|
| E | 5 | 1 |
| F | 4 | 1 |
| G | 5 | 1 |
| Average | 4.71 | 1.14 |

Example 2

As shown in the following Table 3, the thermoreversible compositions of the present invention were prepared with a change in the content of the native gellan gum and the content of the glycerin in the composition of Example 1. The states of the obtained thermoreversible compositions were visually observed to measure viscosity. Results are shown in Table 3.

From the results of Table 3, it is found that gel compositions are obtained when the content of the native gellan gum contained in compositions having a sufficient amount of water is 0.20 wt % or more.

Note that the measurement of viscosity at normal temperature (25° C.) was performed by the following method.

<Viscosity Measurement Method>

Using a revolving viscometer HAKKE RheoStress 1 (manufactured by Thermo Fisher Scientific Inc.), complex viscosity obtained at the measurement of viscoelasticity in a linear deformation region was measured. As a measurement method, 3 mL of a sample was injected into a tray after being heated to 80° C., and a contact was lowered to enclose the sample with silicon oil. When the temperature of the tray reached 80° C., measurement was started to measure viscosity at each temperature up to 25° C.

TABLE 3

| | | 1 | 2 | 3 | 4 | 5 | 6 |
|---|---|---|---|---|---|---|---|
| Composition (wt %) | Native gellan gum | 0.10 | 0.15 | 0.20 | 0.25 | 0.50 | 1.00 |
| | Glycerin | 76.90 | 76.85 | 76.80 | 76.75 | 76.50 | 76.00 |
| | Water | 18% | 18% | 18% | 18% | 18% | 18% |
| Experiment result | Presence or absence of Gelling | X | X | ○ | ○ | ○ | ○ |
| | Viscosity (mPa × s, 25° C.) | 459 | 1015 | 2122 | 4569 | 26,160 | 87,950 |
| | State of obtained gel | Liquid having low viscosity | Liquid having low viscosity | Gel-form composition | Gel-form composition | Gel-form composition | Very strong gel-form composition |

Example 3

As shown in the following Table 4, the thermoreversible compositions of the present invention were prepared with a change in the content of the water and the content of the glycerin in the composition of Example 1. The states of the obtained thermoreversible compositions were visually observed. From the results of Table 4, it is found that a certain degree of the water is needed to dissolve the native gellan gum in the compositions and that the native gellan gum contained in the compositions is substantially dissolved with 5.0 wt % or more of the water to allow the gelling of the compositions.

TABLE 4

| | | 1 | 2 | 3 | 4 | 5 | 6 | 7 | 8 | 9 | 10 | 11 |
|---|---|---|---|---|---|---|---|---|---|---|---|---|
| Composition (wt %) | Water | 0.00 | 1.00 | 2.00 | 3.00 | 4.00 | 5.00 | 6.00 | 7.00 | 13.00 | 18.00 | 99.50 |
| | Native gellan gum | 0.50 | 0.50 | 0.50 | 0.50 | 0.50 | 0.50 | 0.50 | 0.50 | 0.50 | 0.50 | 0.50 |
| | Glycerin | 99.50 | 98.50 | 97.50 | 96.50 | 95.50 | 94.50 | 93.50 | 92.50 | 86.50 | 81.50 | 0.00 |
| Presence or absence of gelling (Good (○): Gelled, Poor(X): Ungelled) | | X | X | X | X | X | ○ | ○ | ○ | ○ | ○ | ○ |

Example 4

Figure 2:
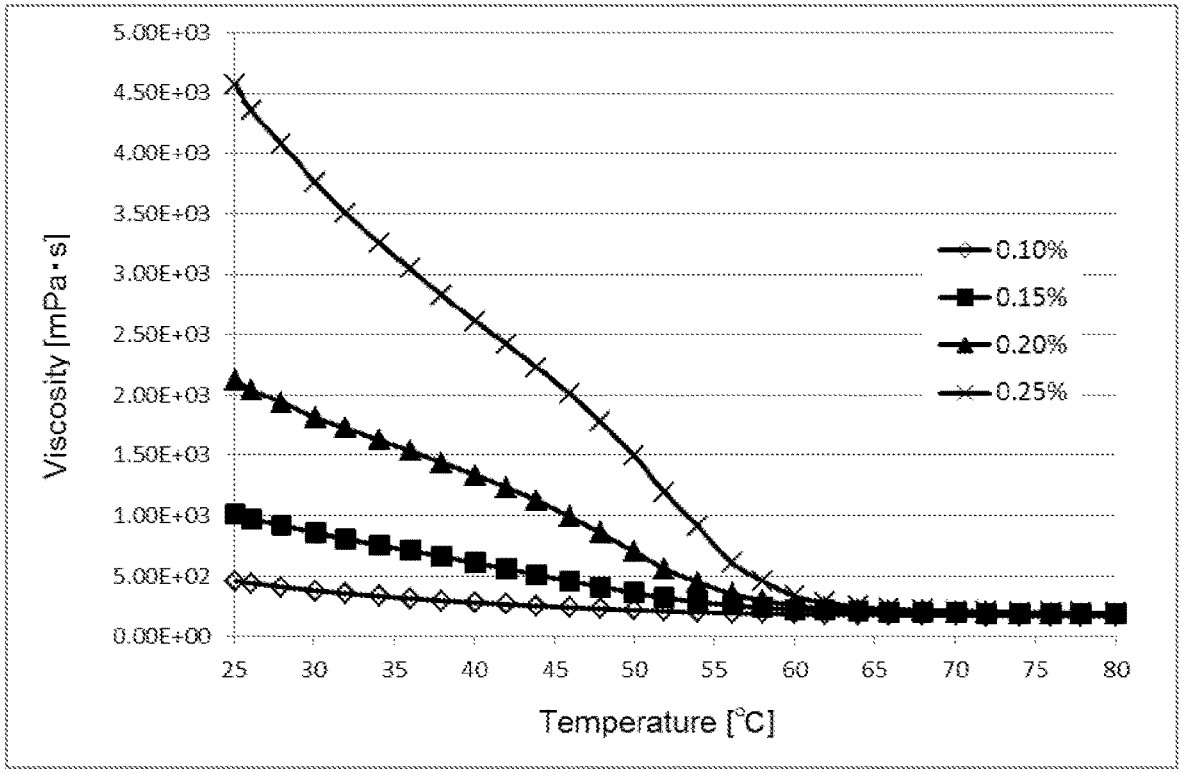
FIG. 2 is a diagram showing the relationship between the viscosity and the temperature of thermoreversible compositions in which the contents of the gelling agent (native gellan gum) are 0.10 wt %, 0.15 wt %, 0.20 wt %, and 0.25 wt % among the thermoreversible compositions of Example 2.

For each of the thermoreversible compositions of the present invention used in Example 2, the relationship between temperature and viscosity was verified. Results are plotted on graphs with the viscosity (mPa·s) in a vertical axis and the temperature (° C.) in a horizontal axis. The thermoreversible compositions in which the contents of the native gellan gum are 0.5 wt % and 1.0 wt % are plotted on FIG. 1, and the thermoreversible compositions in which the contents of the native gellan gum are 0.1 wt %, 0.15 wt %, 0.20 wt %, and 0.25 wt % are plotted on FIG. 2. From the results of FIGS. 1 and 2, it is found that the thermoreversible compositions of the present invention exhibit a sol form at 70° C. and more and a gel-form at 60° C. and less.

Example 5

Figure 3:
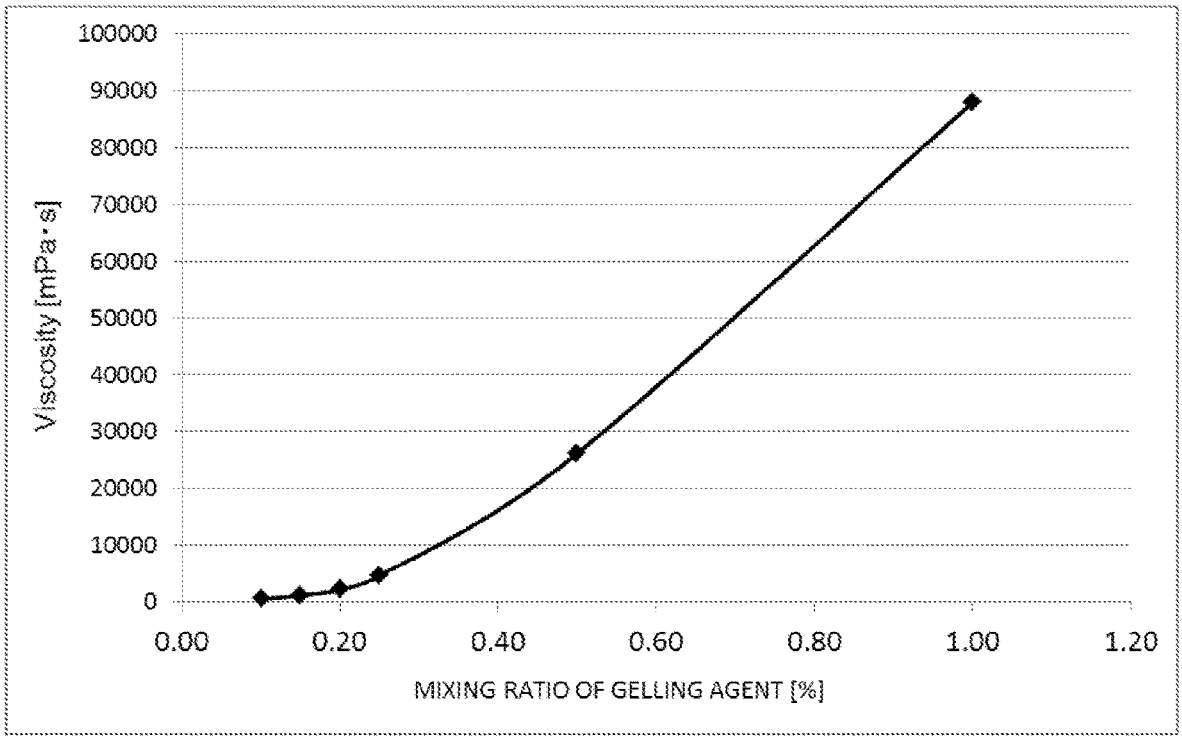
FIG. 3 is a diagram showing the relationship between the viscosity and the mixing ratio of the gelling agent (native gellan gum) in the thermoreversible compositions of Example 2.

The relationship between the content of the gelling agent (native gellan gum) and viscosity (mPa·s) at normal temperature (25° C.) in the gel-form thermoreversible compositions of the present invention was verified. Results are shown in FIG. 3.

The composition of composition matter used in this Example is the same as that used in Example 2.

From the results, it is found that the viscosity increases when the content of the gelling agent (native gellan gum) is large while the amount of the water is equal.

Example 6

An experiment system was prepared in which a gel-form thermoreversible composition containing 0.5 wt % of the native gellan gum, 81.5 wt % of the glycerin, and 18.0 wt % of the water among the compositions manufactured in Example 1 was added into a pod accommodated in an electric heating tobacco tool together with shredded tobacco (Addition of the composition of Example 1).

In addition, an experiment system (additive-free article) in which no composition was added and an experiment system (glycerin-added) in which only glycerin was added were prepared by the same operation.

These experiment systems were vibrated for 72 hours using a Multi Shaker manufactured by Tokyo Rikakikai Co., Ltd. [MMS-310], and the amount of dropped shredded tobacco was measured for each of the systems.

Figure 4:
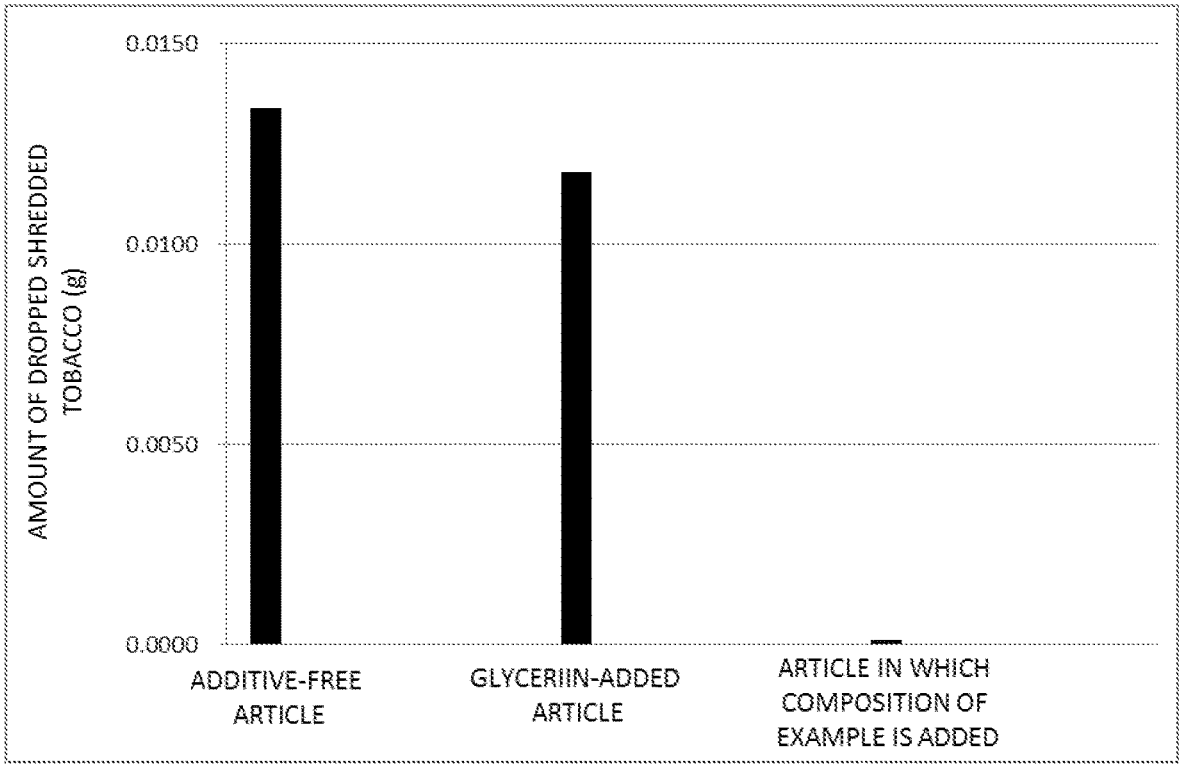
FIG. 4 is a diagram showing the results of the scattering examination of shredded tobacco (in the case of an electric heating tobacco tool).

Results are shown in FIG. 4.

From the results of FIG. 4, it is found that the amount of the dropped shredded tobacco is noticeably small and the ability to retain the shredded tobacco is excellent in the experiment system in which the thermoreversible composition of the present invention is added.

Example 7

In order to verify a loose end, the same materials as those of Example 6 were prepared as materials to be added to shredded tobacco, and an experiment system in which no composition was added to the tip end of a cigarette, an experiment system in which only glycerin was added to the tip end of the cigarette, and an experiment system in which the same gel composition as that of Example 6 was added to the tip end of the cigarette were prepared.

These experiment systems were revolved and swung for 30 minutes using a variable mix rotor [VMR-5R] manufactured by AS ONE Corporation, and the amount of the dropped shredded tobacco was measured for each of these experiment systems.

Figure 5:
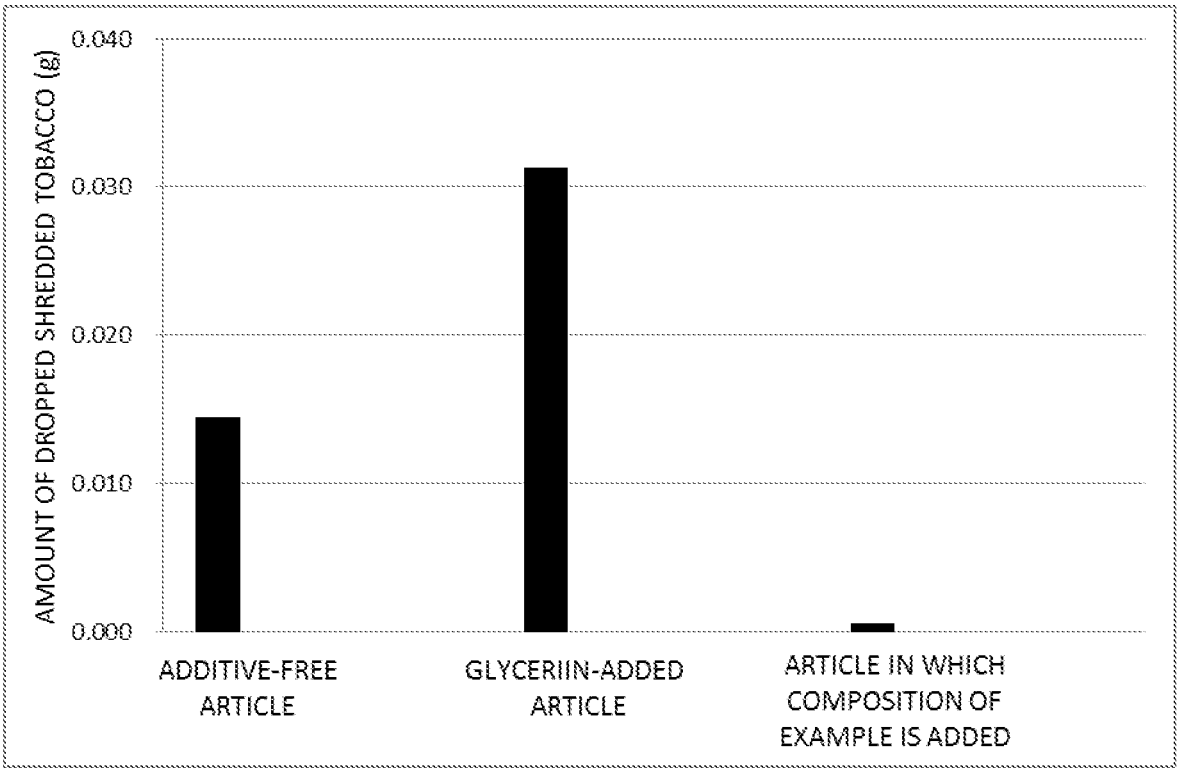
FIG. 5 is a diagram showing the results of the scattering examination of the shredded tobacco (in the case of a cigarette).

Results are shown in FIG. 5. From the results of FIG. 5, it is found that the amount of the dropped shredded tobacco is noticeably small and the ability to retain the shredded tobacco is excellent in the experiment system in which the thermoreversible composition of the present invention is added.

Example 8

The relationship between the content of the water and the heat sensitivity of the gel-form thermoreversible composition of the present invention was verified.

In an aluminum pod (having a volume of 0.47 $cm^3$) accommodated in an electric heating tobacco tool, 42.3 mg (10 parts by weight) of the thermoreversible composition having a different water content, 250 mg (59 parts by weight) of shredded tobacco, and 131 mg (31 parts by weight) of propylene glycol were put. Then, pressure was applied using a jig having a conical tip to the composition containing the shredded tobacco into the pod.

When an overheat lamp switched to a lighting state (temperature reached 165° C.) after an electric heating tobacco tool (PLOOM) was turned on, the prepared pod was arranged in the electric heating tobacco tool, and then, the a thermocouple was inserted into the innermost portion of the pod containing the pressed-shredded tobacco to measure the temperature of the compressed composition. A time (second) until the temperature of the composition (temperature of the article) reached 160° C. was measured. In addition, the temperature of the pod was measured every 15 seconds, and a time at which the temperature of the pod reached 160° C. was measured.

For the measurement of the temperature of the article, a thermocouple (manufactured by Yokogawa Meters & Instruments Corporation (Meter TX1001)) was used.

Figure 6:
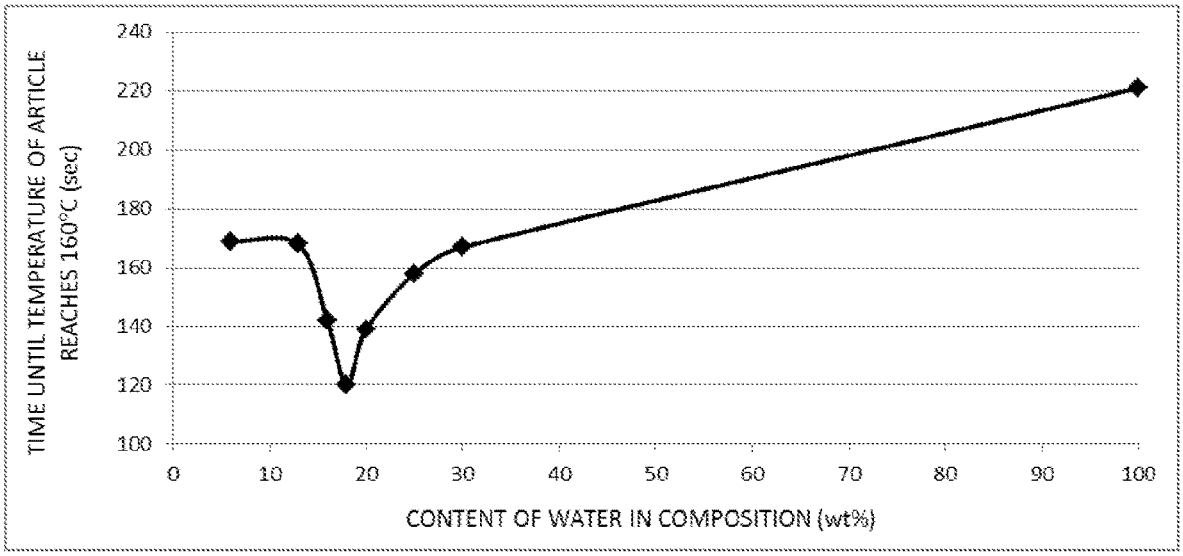
FIG. 6 is a diagram showing the relationship between a water content and thermoreversibility in a gel-form thermoreversible composition.

Obtained results are plotted on the graph of FIG. 6 with the content of the water in the composition in its horizontal axis and a time (second) until the temperature of the composition (temperature of the article) reaches 160° C. in its vertical axis.

From the results of FIG. 6, it is found that the time until the temperature of the composition (temperature of the article) reaches 160° C. is within 180 seconds and that the heat sensitivity of the composition is high within the range of the content of the water contained in the thermoreversible composition of the present invention. In addition, it is found that the heat sensitivity of the composition is higher when the content of the water is 13.0 to 25.0 wt % in the thermoreversible composition of the present invention. It appears that this is because the glycerin causes intercalation with the native gellan gum in a gel structure.

Due to its high heat sensitivity, the temperature of the thermoreversible composition of the present invention efficiently increases with heat from an electronic heater provided in an electric heating tobacco tool, and glycerin contained in the thermoreversible composition is efficiently aerosolized.

In addition, due to its high viscosity, the flowability of the thermoreversible composition of the present invention reduces as the content of a pod arranged inside an electric heating tobacco tool. Thus, the leakage of the thermoreversible composition to the outside the pod or the scattering of elements contained in the thermoreversible composition can be prevented. When the thermoreversible composition of the present invention contains shredded tobacco, scattering during its transportation and so on can be prevented because the shredded tobacco is closely fixed to the inner wall of the pod via the thermoreversible composition.

In addition, when the thermoreversible composition of the present invention is applied to shredded tobacco constituting a cigarette, a loose end can be prevented.

What is claimed is:

1. A thermoreversible composition for a smoking article,
the thermoreversible composition comprising, relative to a total amount of the composition:
69.0 to 94.8 wt % of glycerin;
0.2 to 1.0 wt % of native gellan gum; and
13.0 to 30.0 wt % of water,
wherein said thermoreversible composition has a sol form at 70° C. and more and a gel-form at 60° C. and less.

2. The thermoreversible composition for a smoking article having a sol form at 70° C. and more and having a gel-form at 60° C. and less exhibiting a gel-form at normal temperature according to claim 1, wherein
the thermoreversible composition is obtained by high-speed agitation mixing.

3. The thermoreversible composition for a smoking article having a sol form at 70° C. and more and having a gel-form at 60° C. and less exhibiting a gel-form at normal temperature according to claim 1, wherein
a content of the water in the thermoreversible composition is 13.0 to 25.0 wt %.

4. The thermoreversible composition for a smoking article having a sol form at 70° C. and more and having a gel-form at 60° C. and less exhibiting a gel-form at normal temperature according to claim 1, wherein
a content of the native gellan gum in the thermoreversible composition is 0.5 to 1.0 wt %.

5. The thermoreversible composition for a smoking article having a sol form at 70° C. and more and having a gel-form at 60° C. and less exhibiting a gel-form at normal temperature according to claim 1, wherein
a content of the glycerin in the thermoreversible composition is 74.0 to 86.5 wt %.

6. The thermoreversible composition for a smoking article having a sol form at 70° C. and more and having a gel-form at 60° C. and less exhibiting a gel-form at normal temperature according to claim 1, wherein
a ratio of the native gellan gum to the water in the thermoreversible composition is 1:25 to 13:50.

7. An electric heating tobacco tool comprising:
a thermoreversible composition for a smoking article,
the thermoreversible composition comprising, relative to a total amount of the composition:
69.0 to 94.8 wt % of glycerin;
0.2 to 1.0 wt % of native gellan gum; and
5.0 to 30.0 wt % of water,
wherein said thermoreversible composition has a sol form at 70° C. and more and a gel-form at 60° C. and less.

8. A cigarette comprising:
a thermoreversible composition for a smoking article,
the thermoreversible composition comprising, relative to a total amount of the composition:
69.0 to 94.8 wt % of glycerin;
0.2 to 1.0 wt % of native gellan gum; and
5.0 to 30.0 wt % of water,
wherein said thermoreversible composition has a sol form at 70° C. and more and a gel-form at 60° C. and less.

* * * * *